US012673805B2

(12) United States Patent
Wohlgenannt

(10) Patent No.: US 12,673,805 B2
(45) Date of Patent: Jul. 7, 2026

(54) CLOSURE CAP, CONTAINER COMPRISING THE CLOSURE CAP, AND METHOD FOR PRODUCING A CLOSURE CAP

(71) Applicant: Capartis AG, Schaffhausen (CH)

(72) Inventor: Herbert Wohlgenannt, Schaffhausen (CH)

(73) Assignee: Capartis AG, Schaffhausen (CH)

( * ) Notice: Subject to any disclaimer, the term of this patent is extended or adjusted under 35 U.S.C. 154(b) by 147 days.

(21) Appl. No.: 18/689,893

(22) PCT Filed: Aug. 31, 2022

(86) PCT No.: PCT/EP2022/074212
§ 371 (c)(1),
(2) Date: Mar. 7, 2024

(87) PCT Pub. No.: WO2023/036667
PCT Pub. Date: Mar. 16, 2023

(65) Prior Publication Data

US 2024/0375827 A1 Nov. 14, 2024

(30) Foreign Application Priority Data

Sep. 7, 2021 (EP) ..... 21195293

(51) Int. Cl.
*B65D 41/04* (2006.01)
*B65D 41/06* (2006.01)

(52) U.S. Cl.
CPC ..... *B65D 41/0414* (2013.01); *B65D 41/0485* (2013.01); *B65D 41/065* (2013.01)

(58) Field of Classification Search
CPC ..... B65D 51/245; B65D 51/1688; B65D 41/0414; B65D 41/0485; B65D 41/065; B65D 2401/30; B65D 41/04; B65D 41/3447; B65D 41/365; B65D 55/16
See application file for complete search history.

(56) References Cited

U.S. PATENT DOCUMENTS

| | | | | |
|---|---|---|---|---|
| RE27,156 | E | 7/1971 | Hedgewick | |
| 3,753,510 | A | 8/1973 | Hedgewick et al. | |
| 2017/0020316 | A1* | 1/2017 | Abdiye | B65D 47/20 |

(Continued)

FOREIGN PATENT DOCUMENTS

| | | | |
|---|---|---|---|
| CH | 715914 | A1 | 9/2020 |

OTHER PUBLICATIONS

European Search Report Corresponding to 21195293.2 mailed Mar. 31, 2022.

(Continued)

*Primary Examiner* — Shawn M Braden
(74) *Attorney, Agent, or Firm* — Secant IP, PLLC

(57) ABSTRACT

The invention relates to a closure cap (2) with a closure cap axis (10), a cylindrical cap shell (3), a cover disk (5), and an engagement element (6) formed on the inside of the cap shell (3) and projecting towards the closure cap axis (10), wherein the engagement element (6) is designed as an internally threaded part or as a bayonet locking part, wherein the cover disk (5) has a breakthrough (4) in the region of its periphery, and wherein the engagement element (6) is arranged below the break-through (4) with respect to the breakthrough (4) in the direction of the closure cap axis (10).

26 Claims, 9 Drawing Sheets

(56) References Cited

U.S. PATENT DOCUMENTS

Figure 1:
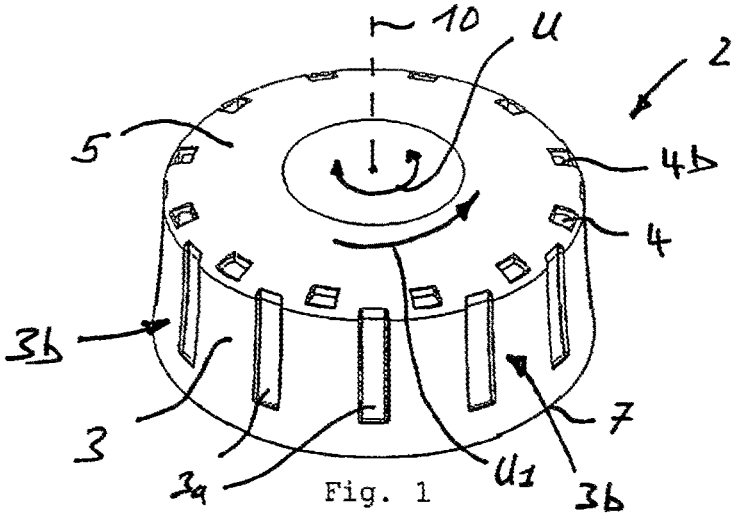

| | | | | |
|---|---|---|---|---|
| 2017/0057139 | A1* | 3/2017 | Zimmermann | B65D 43/0225 |
| 2017/0369210 | A1 | 12/2017 | Defert et al. | |
| 2021/0380316 | A1* | 12/2021 | Gorske | B65D 51/245 |
| 2023/0264869 | A1* | 8/2023 | Sibony | G09F 11/23 220/212 |

OTHER PUBLICATIONS

International Search Report Corresponding to PCT/EP2022/074212 mailed Oct. 17, 2022.
Written Opinion Corresponding to PCT/EP2022/074212 mailed Oct. 17, 2022.

* cited by examiner

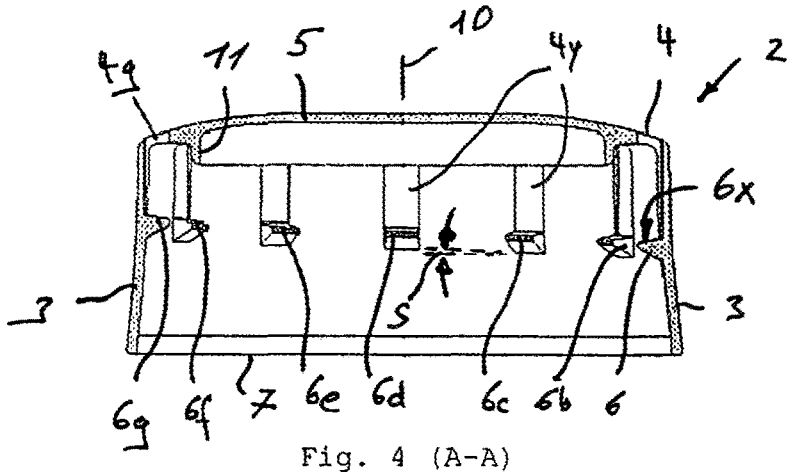
Fig. 4 (A-A)
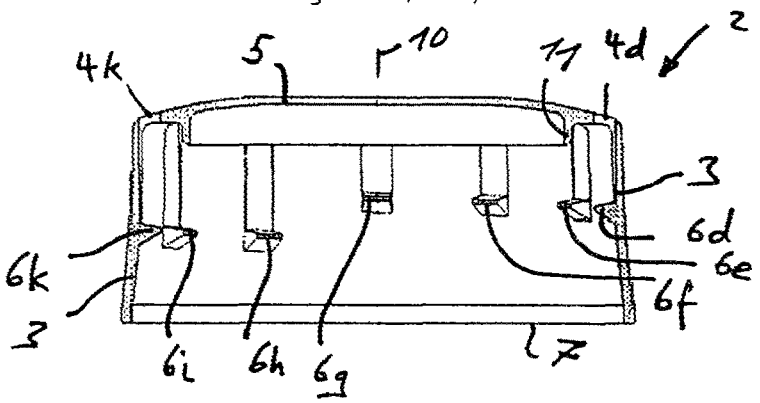
Fig. 5 (B-B)
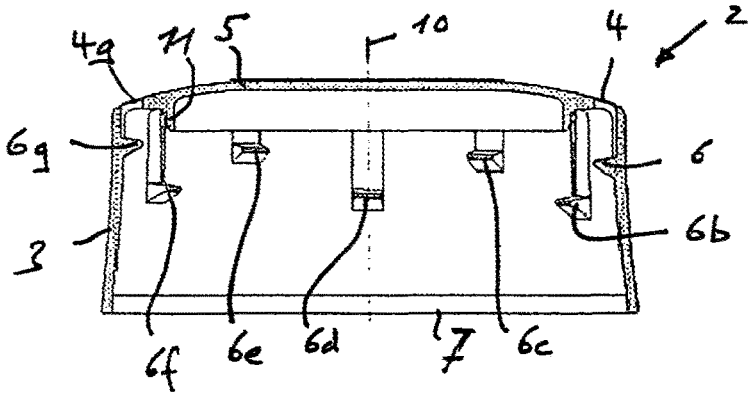
Fig. 6 (A-A)
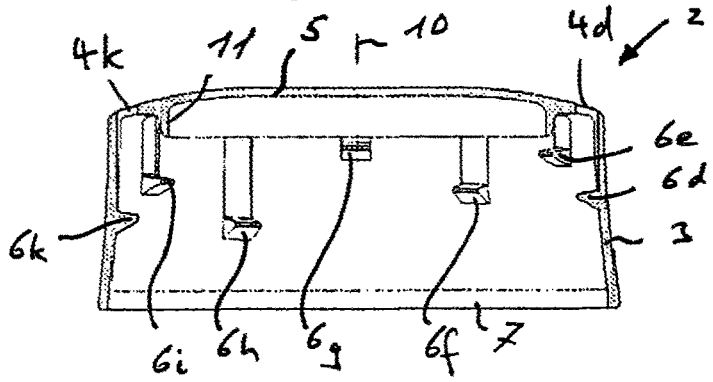
Fig. 7 (B-B)

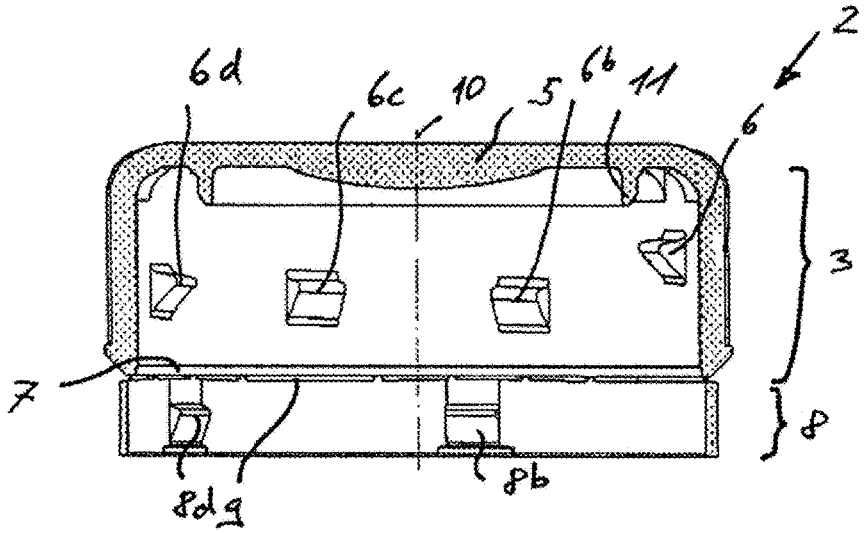
Fig. 18 (C-C)
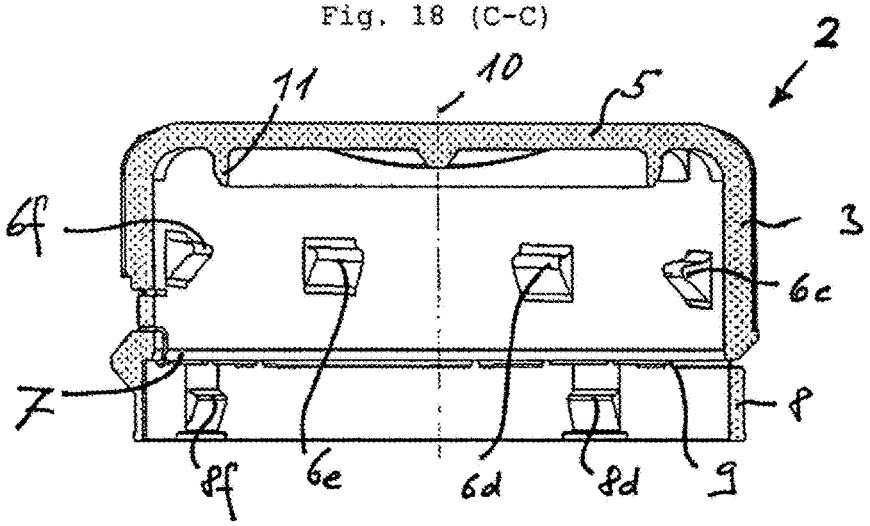
Fig. 19 (D-D)
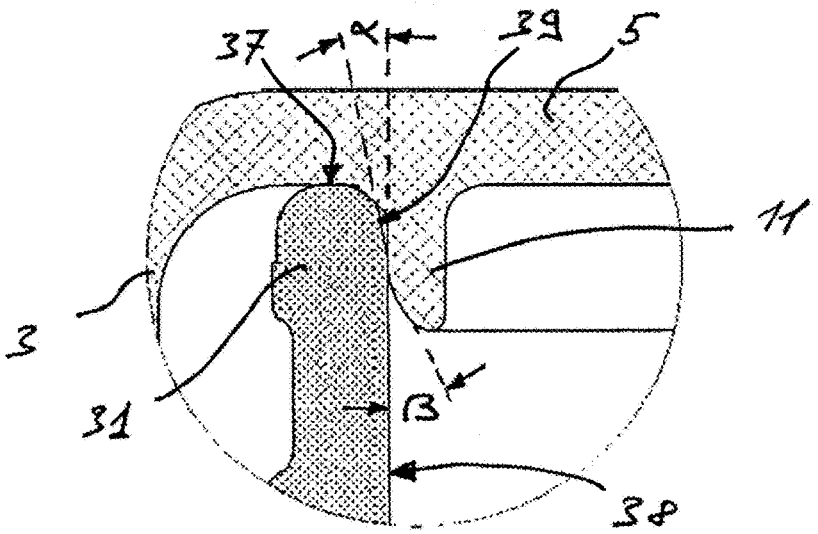
Fig. 20

CLOSURE CAP, CONTAINER COMPRISING THE CLOSURE CAP, AND METHOD FOR PRODUCING A CLOSURE CAP

The present invention relates to a closure cap for a screw cap. The present invention also relates to a container comprising a closure cap. The present invention further relates to a method of manufacturing a closure cap for a screw cap.

Known containers comprising a container body and a closure cap which closes the container body have the disadvantage that their recycling is extremely costly. Such containers, which are used as disposable beverage containers, for example, are produced in enormous quantities and should be disposed of properly and preferably recycled in the future. The recycling of such beverage containers is very complex because the container body and the cap are usually made of different materials, with the container body usually being made of PET (polyethylene terephthalate) and the cap usually being made of an elastic solid material such as PE (polyethylene) or PP (polypropylene). Such beverage containers are usually returned either with the cap in place, or at least with partial components of the cap such as the warranty tape. However, optimum recycling of the materials of such beverage containers is only possible if the materials are separated by type after recycling. Completely removing the cap or warranty tape from the container body is very time-consuming, which is why such beverage containers are sometimes incinerated and therefore not recycled.

Known beverage containers comprise, for example, a container body designed as a PET bottle and comprise a closure cap, for example designed as a so-called PCO-28 closure, either 21 mm (type 1810) or 18 mm (type 1881) high.

The document US2017/0057139A1 discloses a closure cap and a method for manufacturing the same. However, this closure cap is not suitable for closing known beverage containers such as PET bottles, and in particular for closing PET bottles with a PCO-28 screw cap, without an additive. First-time opening cannot be proven. In addition, a beverage container containing a pressurized fluid cannot be reliably closed with this closure cap. The document U.S. Pat. No. 3,753,510 discloses a multi-part closure cap, the manufacture of which is very complex.

Based on the aforementioned prior art, the present invention is based on the task of at least reducing such and other disadvantages of the prior art and, in particular, of disclosing a closure cap of the type mentioned at the beginning which, compared to the known closure caps, is preferably easier to recycle and preferably also easier to manufacture. In addition, the present invention is based on the task of simplifying the recycling of containers comprising the closure cap.

The task is solved by a closure cap, a container comprising such a closure cap, and a method for manufacturing such a closure cap, having the features of the independent claims. Advantageous embodiments and further developments are the subject of the dependent claims.

The problem is solved in particular by a closure cap with a closure cap axis, a cylindrical cap shell, a cover disk and an engagement element formed on the inside of the cap shell and projecting towards the closure cap axis, wherein the engagement element is designed as an internally threaded part or as a bayonet locking part, and wherein the cover disk has a breakthrough in the region of its periphery, and wherein the engagement element is arranged below the breakthrough with respect to the break-through in the direction of the closure cap axis, and preferably in alignment with respect to the breakthrough. The closure cap comprises at least one engagement element and preferably a plurality of engagement elements arranged mutually spaced apart in the circumferential direction, each engagement element being assigned a breakthrough in the direction of the closure cap axis. Each engagement element advantageously extends in the circumferential direction of the closure cap axis by a maximum of the width of the associated breakthrough, the internal thread of the closure cap being formed by the sum of the engagement elements.

The task is furthermore solved in particular with a method for producing a closure cap having a closure cap axis, a cover disk and a cylindrical cap shell with an engagement element projecting towards the closure cap axis, in that a first mold tool half and a second mold tool half form a shaping cavity in the closed state, in that the outer contour of the closure cap is determined by the first mold tool half, in that the inner contour of the closure cap is essentially determined by the second mold tool half, the first mold tool half having a finger-like engagement element projecting in the direction of the closure cap axis, in the direction of the closure cap axis, which projects into the cavity, a cavity part delimiting the engagement element being defined by a mold part of the second mold half and by a tip of the web of the first mold half, so that when the cavity is filled with plastic, the closure cap comprising the cover disk and the cap shell with engagement element is produced, whereby the web also creates an opening in the cover disk, whereby the two halves of the mold are displaced relative to each other during opening, and the closure cap produced is released and ejected without forced demolding or spindling. The first and second mold halves preferably form a common interior, whereby the common interior is preferably free of undercuts. The closure cap, which is still in the molding tool immediately after its production, is thus preferably removed from the molding tool without undergoing plastic deformation. The closure cap according to the invention can therefore also be produced from a material such as PET.

The closure cap according to the invention is particularly advantageously designed such that the entire closure cap can be produced by injection molding without forced demolding, whereby the entire closure cap is preferably designed without undercuts. In an advantageous embodiment, the closure cap also comprises a sealing lip on the cover disk, preferably a sealing lip formed on the cover disk, with the sealing lip running concentrically to the closure cap axis. The sealing lip preferably has a length in the range from 1 mm to 3 mm in the direction of the closure cap axis, particularly preferably in the range from 1.7 mm to 2.3 mm. The closure cap can, for example, have a total height in the range of 18 mm to 21 mm in the direction of the closure cap axis. The entire sealing cap comprising the sealing lip is preferably designed in one piece. Advantageously, the sealing lip does not have an undercut, so that the sealing lip can also be produced without forced demolding. In a further possible embodiment, however, the sealing lip can also have an undercut so that the closure cap, with the exception of the sealing lip, can be produced without forced demolding.

The process for manufacturing the closure cap makes it possible to manufacture it preferably without forced demolding. This has the advantage that the closure cap can be produced particularly cost-effectively, for example from materials consisting essentially of PET, PE or PP, but particularly preferably from PET or essentially from PET. In an advantageous embodiment, the closure cap preferably has a length in the range of 18 mm to 21 mm in the direction of the closure cap axis.

Beverage bottles are usually made from the plastic PET (polyethylene terephthalate). PET is a very stable plastic that cannot be stretched or can only be stretched very slightly in the injection molding process. Because PET is extremely tough and resistant, this plastic is very break-proof. This is one of the main reasons why beverage bottles are very often made of PET, especially as PET also has a high barrier property that can retain carbon dioxide. PET also has a high aroma density and very good grease resistance.

In a particularly advantageous embodiment, the closure cap according to the invention is also made of PET. The closure cap according to the invention is designed in such a way that the method according to the invention for producing the closure cap only has process steps which do not require any forced demolding during production. The closure cap is preferably manufactured in a mold with a cavity free of undercuts. The mold preferably comprises two mold halves that form an undercut-free cavity. To produce the closure cap, injection molding material is introduced into the cavity, the two mold halves being pulled apart after the injection molding material has hardened and thereby opened, and the closure cap produced undergoing no forced deformation during opening of the mold and during removal from the mold. It is therefore possible with the method according to the invention to nevertheless produce a closure cap consisting of PET or essentially consisting of PET. The method according to the invention is of course also suitable for producing caps consisting of materials other than PET, for example PE or PP.

The closure cap according to the invention, consisting of PET or essentially of PET, is particularly advantageously used in combination with container bodies consisting of PET or essentially of PET, so that the entire container, i.e. both the container body and the closure cap, consists preferably of the same PET material. Such a container is extremely easy to recycle, as it is no longer necessary to separate the material of the closure parts and the container body. The closure cap is also particularly advantageously designed in such a way that the closure cap cannot be separated from the container body even after opening, or can only be separated with great effort, so that it preferably remains captively connected to the container body. Such a container has the advantage that the entire container comprising the container body and the closure cap can be recycled and that individual parts such as an individual closure cap or an individual warranty tape are avoided. Such a container is therefore extremely environmentally friendly because, on the one hand, dismantling of the container by separating individual parts is avoided and, on the other hand, the container can be recycled completely and unmixed without time-consuming sorting of different materials.

Preferably, the container comprising the container body and the closure cap is made of the same material, such as PET. However, in addition to PET, other materials, which are not listed in detail herein, are also suitable for producing the container body and the closure cap from the same material. The method according to the invention and the closure cap according to the invention enable production without forced demolding, so that closure caps consisting of materials can also be produced which were previously unsuitable for the production of closure caps because forced demolding was previously required during the production of a closure cap, for example in that a closure cap produced in a molding tool could only be removed from the molding tool by forced demolding.

Figure 2:
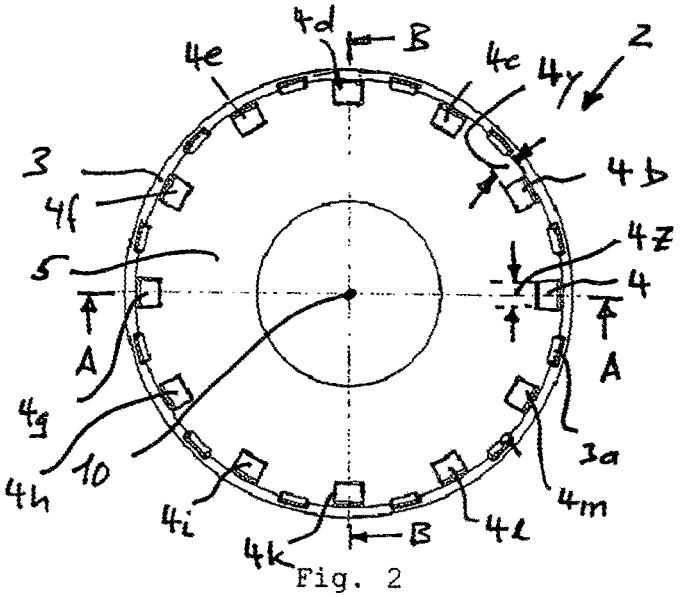
Figure 3:
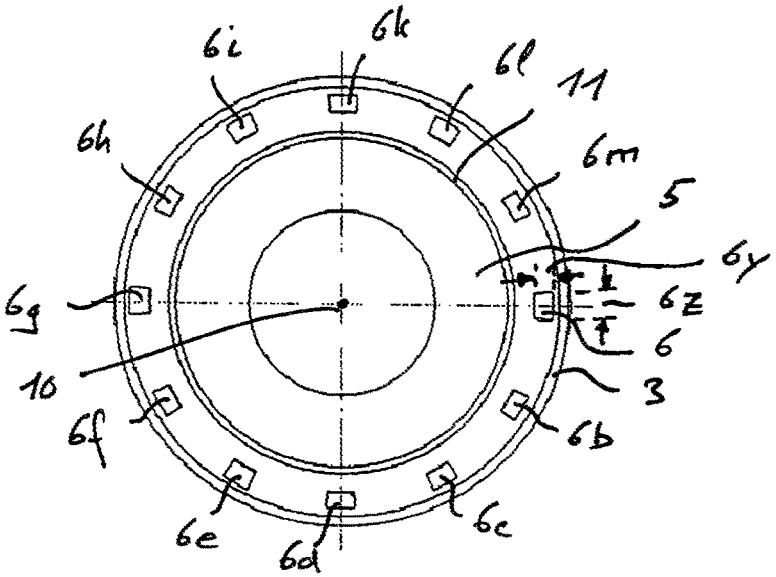
Figure 8:
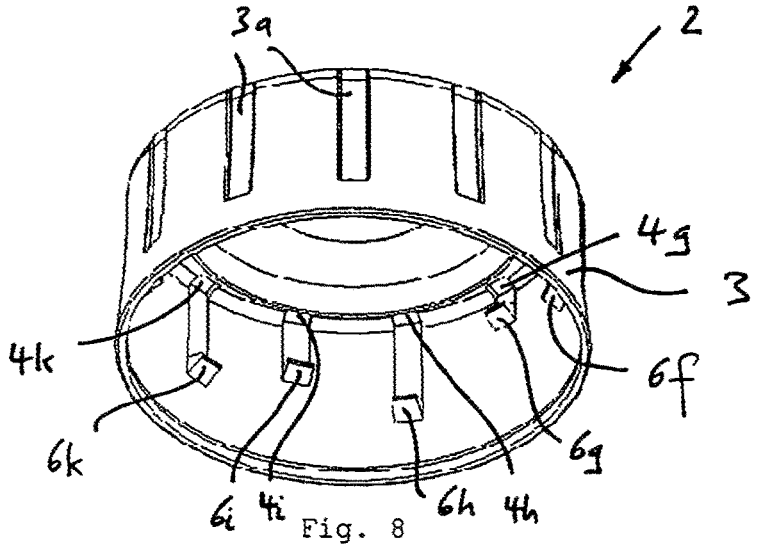
Figure 9:
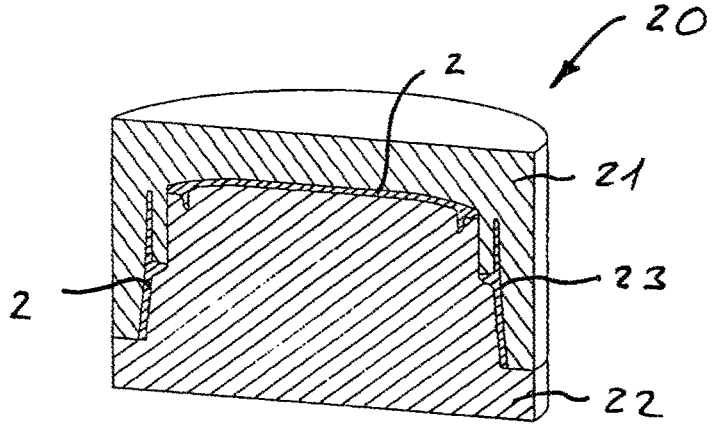
Figure 10:
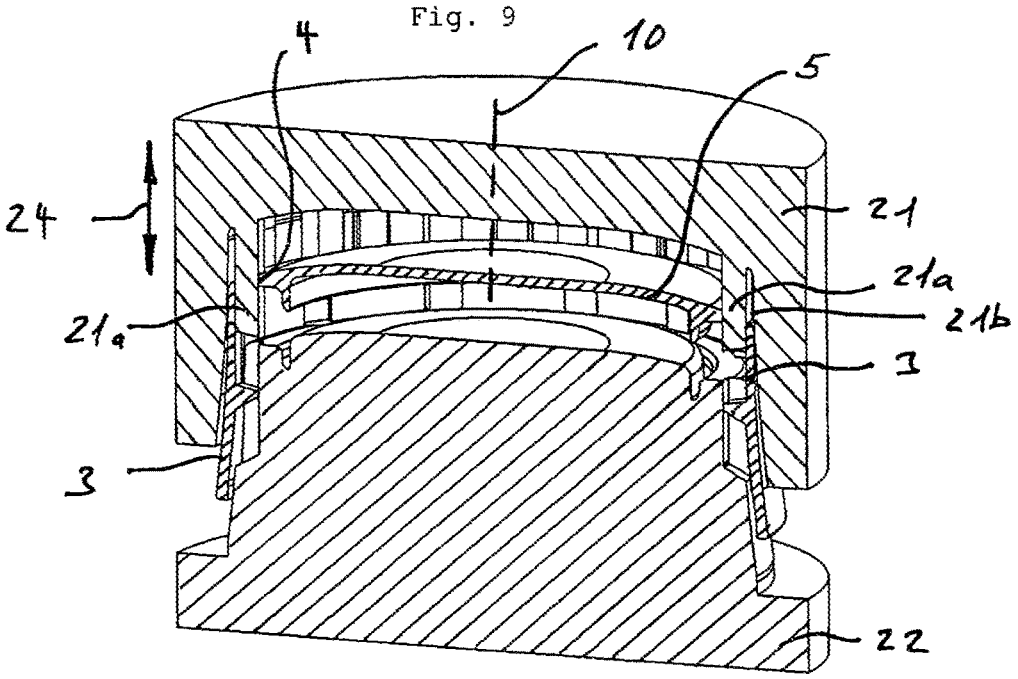
Figure 11:
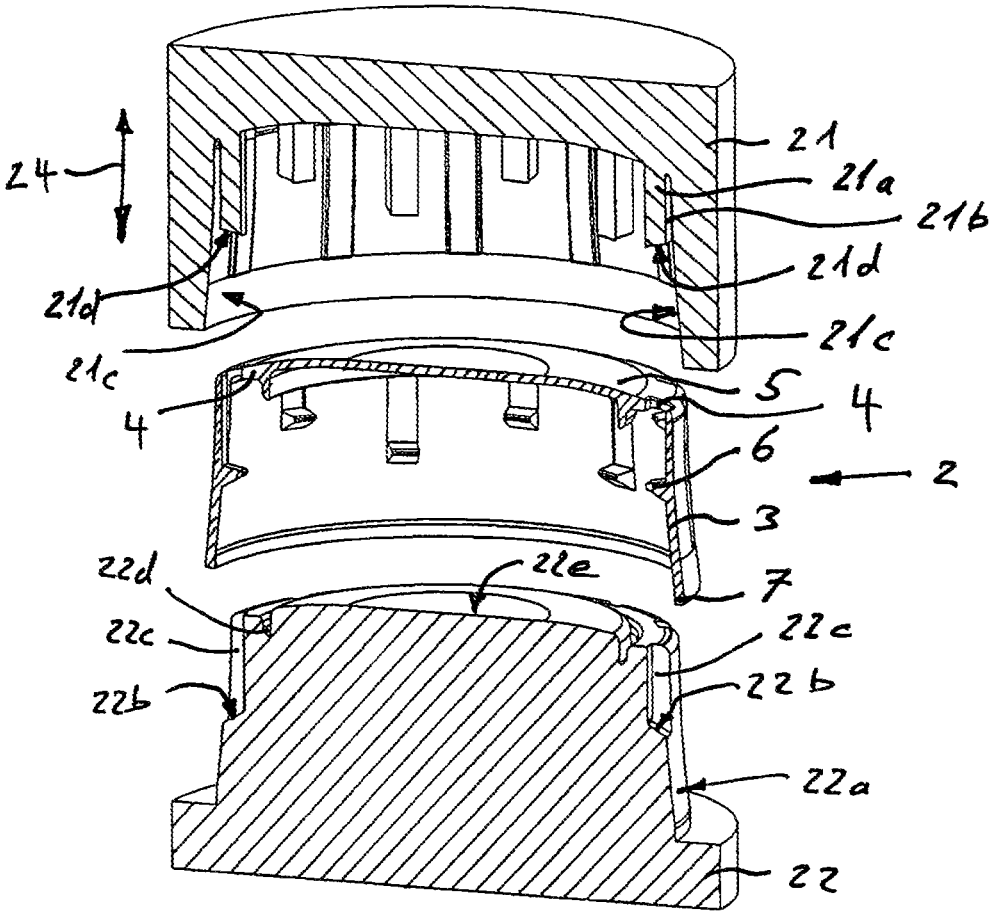
Figure 12:
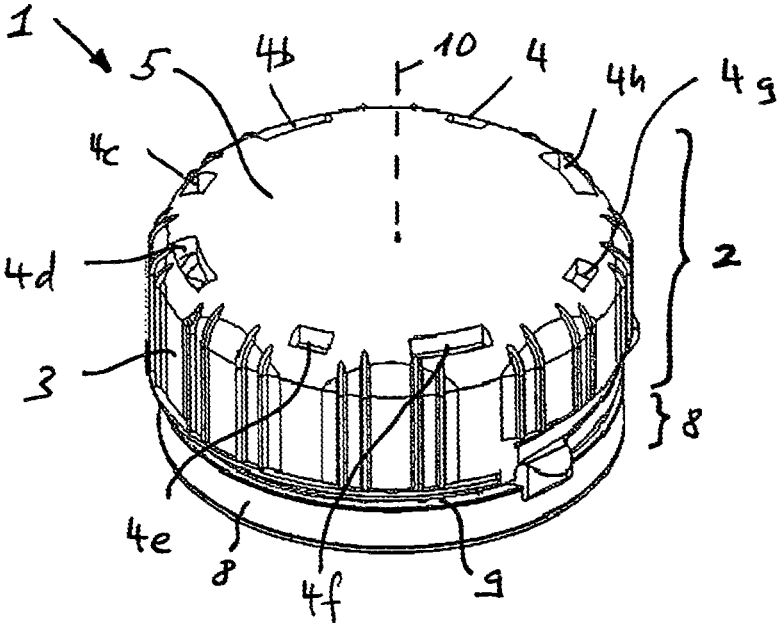
Figure 13:
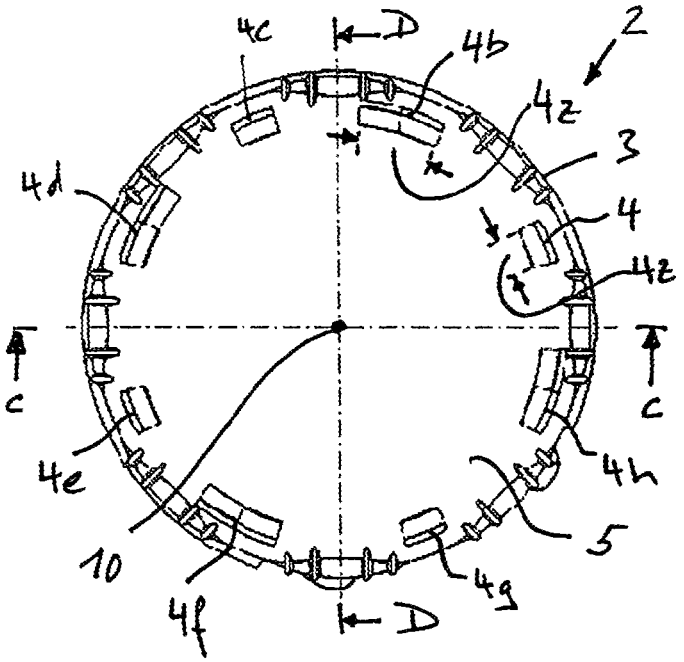
Figure 14:
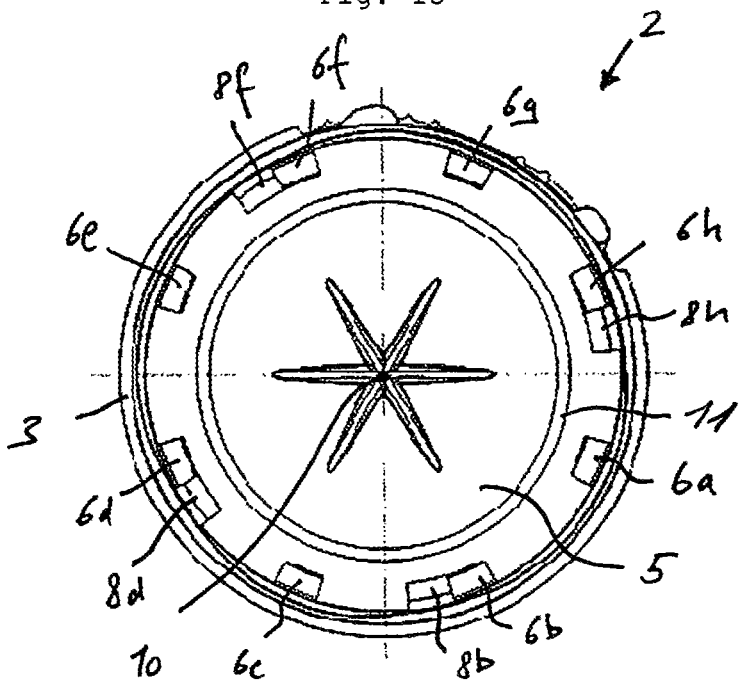
Figure 15:
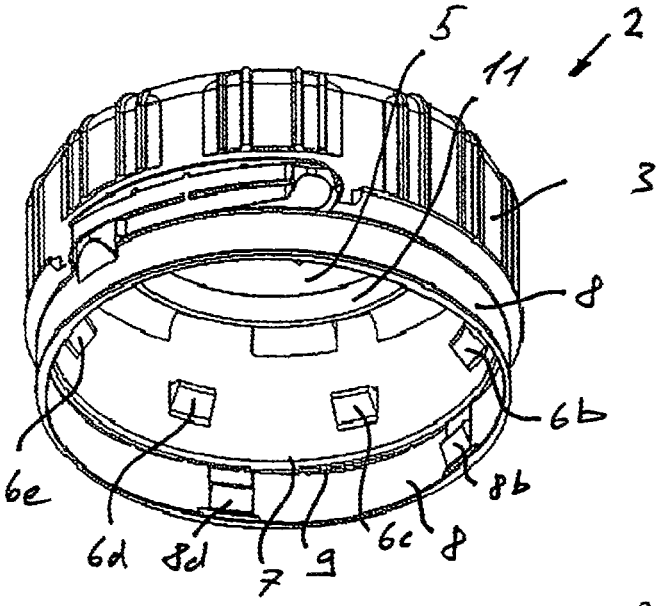
Figure 16:
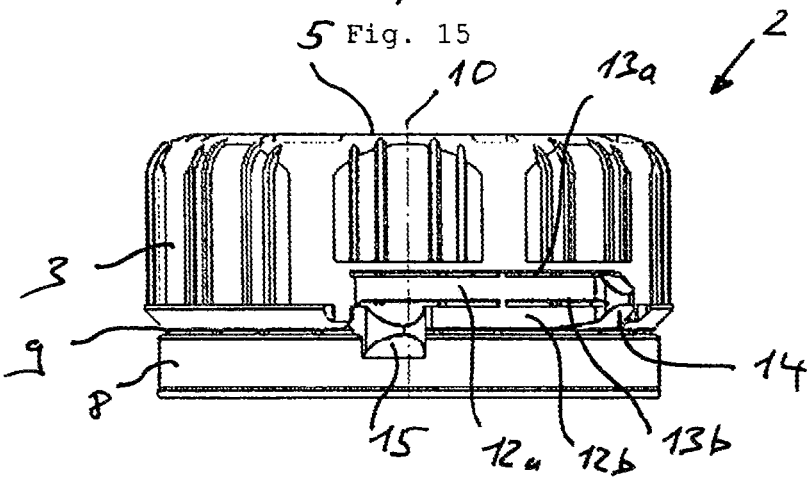
Figure 17:
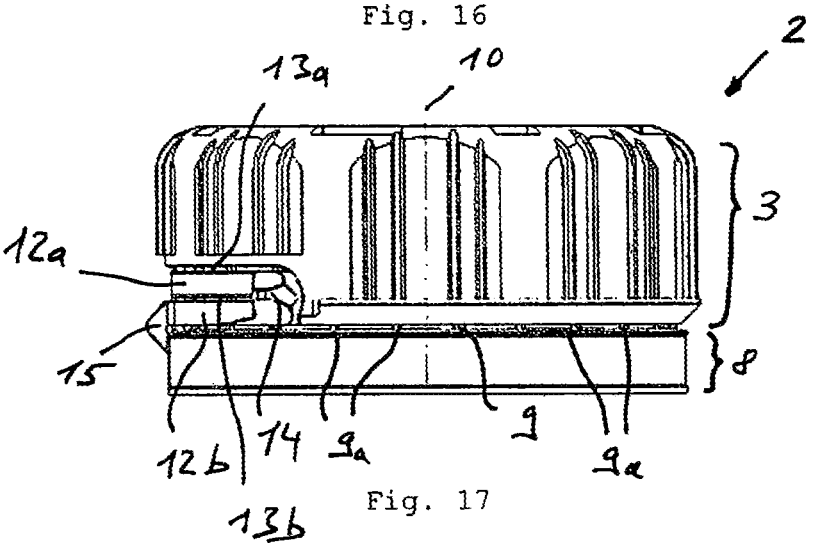
Figure 21:
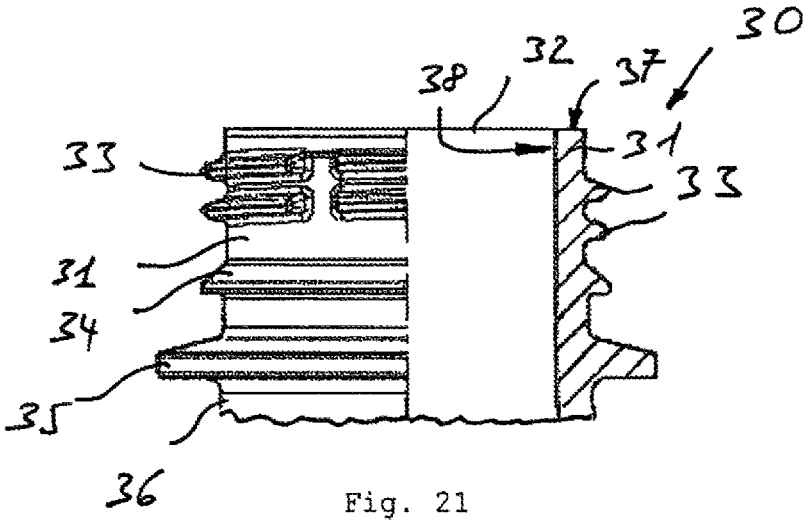
Figure 22:
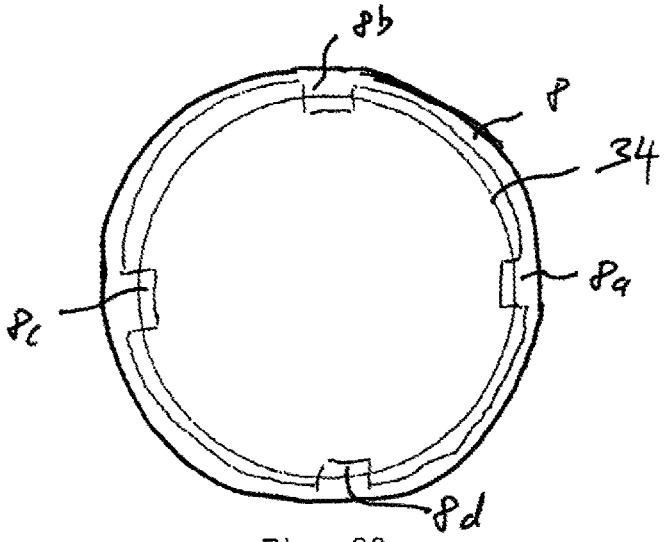
Figure 23:
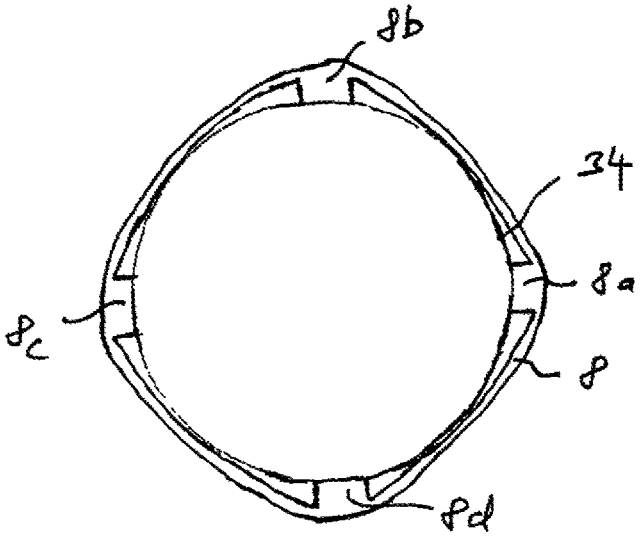
Figure 24:
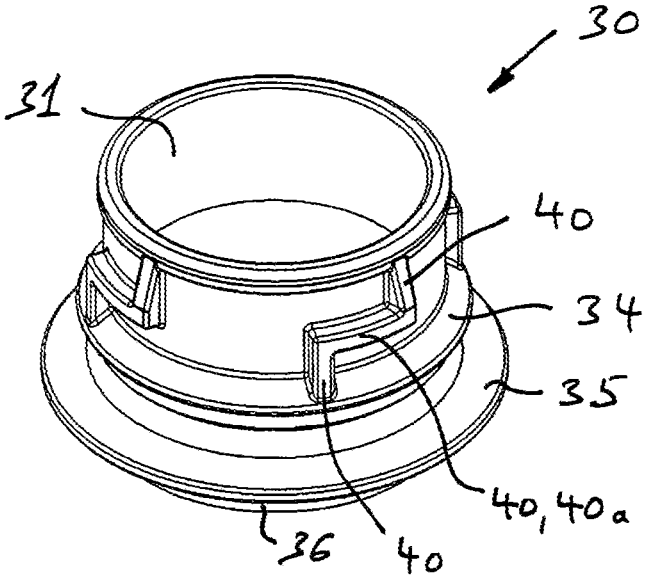
Figure 25:
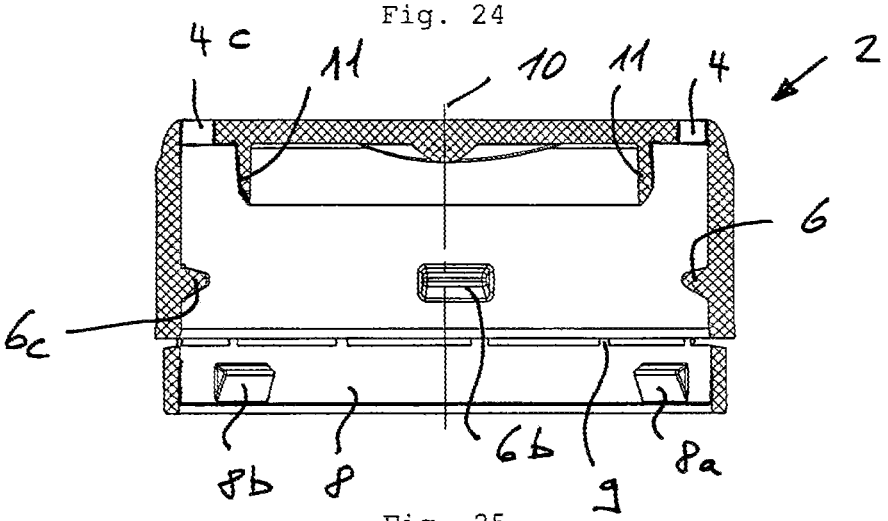

Various embodiments of the invention are described below with reference to drawings, whereby identical or corresponding elements are generally provided with identical reference lines. The drawings show FIG. 1 a perspective top view of a closure cap according to the invention;

FIG. 2 a top view of the closure cap according to FIG. 1;

FIG. 3 a bottom view of the closure cap according to FIG. 1;

FIG. 4 a longitudinal section through the closure cap along the line A-A according to FIG. 2;

FIG. 5 a longitudinal section through the closure cap along line B-B according to FIG. 2;

FIG. 6 a longitudinal section through a further embodiment of a closure cap along line A-A according to FIG. 2;

FIG. 7 a longitudinal section through the embodiment example according to FIG. 6 along line B-B according to FIG. 2;

FIG. 8 a perspective bottom view of the closure cap shown in FIGS. 6 and 7;

FIGS. 9, 10 and 11 a molding tool and process steps in the manufacture of a closure cap;

FIG. 12 a perspective top view of a further embodiment of a closure cap according to the invention;

FIG. 13 a top view of the closure cap according to FIG. 12;

FIG. 14 a bottom view of the closure cap according to FIG. 12;

FIG. 15 a perspective bottom view of the closure cap according to FIG. 12;

FIG. 16 a side view of the closure cap according to FIG. 12;

FIG. 17 a side view of the closure cap rotated by 90° according to FIG. 16;

FIG. 18 a longitudinal section through the closure cap along the line C-C according to FIG. 13;

FIG. 19 a longitudinal section through the closure cap along line D-D as shown in FIG. 13;

FIG. 20 a longitudinal section of a detailed view of a container outlet opening closed with a closure cap according to the invention;

FIG. 21 a side view of a container neck of a container body;

FIG. 22 a view of a warranty tape after it has been attached to a container neck ring;

FIG. 23 a process step during the attachment of the warranty tape of the closure cap to the container neck ring;

FIG. 24 an embodiment of a container neck for securing the closure cap with a bayonet lock;

FIG. 25 a closure cap comprising a bayonet locking part for fastening to the container neck according to FIG. 24.

FIG. 1 shows a perspective view of a closure cap 2 according to the invention with a closure cap axis 10, a substantially cylindrical cap shell 3, a cover disk 5 and a free edge 7, the closure cap 2 consisting essentially of the cap shell 3 and the cover disk 5, which delimits the cylindrical cap shell 3 at the top. The closure cap axis 10 runs through the center of the cover disk 5, and the cylindrical cap shell 3, in particular its outer surface 3*b*, preferably runs concentrically to the closure cap axis 10. The free edge 7 is located at the end of the closure cap 2 opposite the cover disk 5 with respect to the direction of the closure cap axis 10. In one possible embodiment, the cap shell 3 runs exactly parallel to the closure cap axis 10. Particularly preferably, the cap shell 3 has a slightly widening, in particular conically widening course in the direction of the closure cap axis 10, as shown for example in FIG. 4, from the cover disk 5 to the free edge 7, with an angle relative to the closure cap axis 10 in the range of, for example, 0.1° to 5°. This slight widening of the cap shell 3 in the direction of the closure cap axis 10 has the advantage that the closure cap 2 can be removed more easily, and preferably without forced demolding, from a molding tool after it has been manufactured. A cap shell 3 designed in this way is also referred to herein as a cylindrical cap shell, since the cap shell 3 extends cylindrically or essentially cylindrically with respect to the closure cap axis 10.

The cap 2 has a circumferential direction U concentric to the cap axis 10, whereby the cap 2 can be opened with a rotation in the opening direction of rotation U1. The cap shell 3 has an outer surface 3*b*, which can be designed and structured in a variety of embodiments. In the embodiment example shown, the outer surface 3*b* comprises a plurality of grooves 3*a* running in the direction of the closure cap axis 10. This design has the advantage that the outer surface 3*b* can be held better with the fingers.

FIG. 2 shows a top view and FIG. 3 a bottom view of the closure cap 2 according to FIG. 1, and FIGS. 4 and 5 show a longitudinal section through the closure cap 2 according to FIG. 2 along section line A-A and section line B-B respectively.

In an advantageous embodiment, the closure cap 2 comprises a single engagement element 6 formed on the inside of the cap shell 3 and projecting from the cap shell 3 towards the closure cap axis 10, wherein the engagement element 6 is designed as an internally threaded part or as a bayonet locking part. In this embodiment, the cover disk 5 preferably has a single break-through 4 in the region of its periphery, wherein the engagement element 6 is arranged with respect to the breakthrough 4 in the direction of the closure cap axis 10, in particular in the direction of extension of the closure cap axis 10, and below the breakthrough 4, in the direction of the closure cap axis 10 in a region between the cover disk 5 and the free edge 7. As shown in particular in FIG. 4, the engagement element 6 is arranged below the breakthrough 4 with respect to the breakthrough 4 in the extension direction of the closure cap axis 10, so that a parallel line to the closure cap axis 10 running through the engagement element 6 also runs through the opening surface of the breakthrough 4. In an advantageous embodiment, the engagement element 6 is arranged in alignment with the breakthrough 4 in the direction of the closure cap axis 10. In other words, in an advantageous embodiment, the engagement element 6 is dimensioned in such a way that a light beam extending in the direction of the closure cap axis 10 and shining through the breakthrough 4 defines the maximum dimension of the engagement element 6 in a plane extending perpendicular to the direction of the closure cap axis 10. This aligned arrangement of engagement element 6 and breakthrough 4 in the direction of the closure cap axis 10 can be seen in particular from FIG. 4, in that the engagement element 6, or the surface 6*x* of the engagement element 6 aligned towards the breakthrough 4, is arranged in alignment with the breakthrough 4 in the direction of the closure cap axis 10, wherein the surface 6*x* can run perpendicular to the closure cap axis 10 or, as shown in FIG. 4, can run at an angle deviating from the perpendicular with respect to the closure cap axis 10, wherein the surface 6*x* can run flat or also curved.

As shown in FIG. 2, the breakthrough 4 has a breakthrough length 4*z* in the circumferential direction U and has a breakthrough width 4*y* radial to the closure cap axis 10. As shown in FIG. 3, the engagement element 6 has an engagement element length 6*z* in the circumferential direction U and has an engagement element width 6*y* radially to the closure cap axis 10. Advantageously, the engagement element 6 is arranged in alignment with the breakthrough 4 in the direction of the closure cap axis 10 in such a way that the engagement element length 6*z* corresponds to the breakthrough length 4*z*, or these have the same or essentially the same length, and preferably also in such a way that the engagement element width 6*y* corresponds to the breakthrough width 4*y*, or these have the same or essentially the same width. It may prove advantageous to design the engagement element length 6*z* slightly smaller than the breakthrough length 4*z* and/or to design the engagement element width 6*y* slightly smaller than the breakthrough width 4*y*, in particular in order to make it easier to remove a closure cap 2 produced by injection molding from a molding tool.

In a further, advantageous embodiment, the breakthrough 4 has a breakthrough length 4*z* with respect to the circumferential direction U, and the engagement element 6 has an engagement element length 6*z* in the circumferential direction U, wherein the breakthrough length 4*z* is greater than or equal to the engagement element length 6*z*, wherein the breakthrough length 4*z* is preferably at least twice as great as the engagement element length 6*z*.

In a further advantageous embodiment, the locking cap 2, as shown in FIGS. 1 to 5, has a plurality of breakthroughs 4, 4*b*, 4*c* and engagement elements 6, 6*b*, 6*c*, which are arranged mutually spaced apart in the circumferential direction U, preferably mutually evenly spaced apart, wherein each engagement element 6, 6*b*, 6*c* is assigned a corresponding breakthrough 4, 4*b*, 4*c* in the direction of the closure cap axis 10, wherein the engagement element length 6*z* of the engagement element 6, 6*b*, 6*c* is less than or equal to the breakthrough length 4*z* of the respectively assigned breakthrough 4, 4*b*, 4*c*.

In a further advantageous embodiment, the engagement element lengths 6*z* of the engagement elements 6, 6*b*, 6*c* are of the same length as the breakthrough length 4*z* of the respectively associated breakthrough 4, 4*b*, 4*c*, and preferably, as shown in FIGS. 1 to 5, all breakthroughs 4, 4*b*, 4*c* and all engagement elements 6, 6*b*, 6*c* have the same length in the circumferential direction U.

In an advantageous embodiment, the closure cap 2 has at least two breakthroughs 4, 4*b* and two engagement elements 6, 6*b*, wherein each engagement element 6, 6*b* is assigned a respective breakthrough 4, 4*b*, wherein the closure cap 2 may in particular have between two and twenty engagement elements 6, 6*b*, 6*c*, 6*d*, 6*e*, 6*f*, 6*g*, 6*h*, 6*i*, 6*k*, 6*l*, 6*m*, and may correspondingly have between two and twenty associated breakthroughs 4, 4*b*, 4*c*, 4*d*, 4*e*, 4*f*, 4*g*, 4*h*, 4*i*, 4*k*, 4*l*, 4*m*. Particularly preferably, the closure cap 2 comprises at least eight and preferably at least twelve engagement elements 6, 6*b*, 6*c* and preferably at least eight and preferably at least twelve breakthroughs 4, 4*a*, 4*b*, each assigned to one of the engagement elements 6, 6*b*, 6*c*.

An inwardly projecting sealing lip 11 is preferably formed on the cover disk 5 of the closure cap 2, whereby the sealing lip 11 can also be in the form of a sealing cylinder or a sealing cone, for example. As shown in FIGS. 4 to 7, the sealing lip 11 is particularly advantageously designed without an undercut. Particularly advantageously, the cover disk 5 of the closure cap 2, as shown for example in FIG. 4, 5, 18, 19 or 20, comprises a circumferential sealing lip 11 which, as shown for example in FIGS. 3 and 14, extends in the circumferential direction U between the breakthrough 4 or the breakthroughs 4, 4*b*, 4*c*, 4*d*, 4*e*, 4*f*, 4*g*, 4*h*, 4*i*, 4*k*, 4*l*, 4*m* and the closure cap axis 10. The sealing cap 2 and the sealing lip 11 are designed in one piece.

As shown in FIGS. 4 and 5, each of the engagement elements 6, 6*b*, 6*c*, 6*d*, 6*e*, 6*f*, 6*g*, 6*h*, 6*i*, 6*k*, 6*l*, 6*m* forms an internally threaded part, whereby these are advantageously arranged mutually offset in the direction of the closure cap axis 10 in such a way that the entirety of the engagement elements 6, 6*b*, 6*c*, 6*d*, 6*e*, 6*f*, 6*g*, 6*h*, 6*i*, 6*k*, 6*l*, 6*m* and the closure cap axis 10 are mutually offset, that the entirety of the engagement elements 6, 6*b*, 6*c*, 6*d*, 6*e*, 6*f*, 6*g*, 6*h*, 6*i*, 6*k*, 6*l*, 6*m* form an internal thread with a pitch S in the circumferential direction U, whereby this internal thread, as can be seen from FIG. 5, extends essentially through almost 360° in the circumferential direction U.

In contrast to the embodiment example shown in FIGS. 4 and 5, the engagement elements 6, 6*b*, 6*c*, 6*d*, 6*e*, 6*f*, 6*g*, 6*h*, 6*i*, 6*k*, 6*l*, 6*m* shown in FIGS. 6, 7 and 8 have a different arrangement, whereby these engagement elements are arranged mutually offset in the direction of the closure cap axis 10 in such a way that the entirety of the engagement elements 6, 6*b*, 6*c*, 6*d*, 6*e*, 6*f*, 6*g*, 6*h*, 6*i*, 6*k*, 6*l*, 6*m* in turn form an internal thread in the circumferential direction U, this internal thread extending essentially by almost 720° in the circumferential direction U. The locking cap according to the invention has the advantage that the total length of the internal thread formed by the engagement elements in the circumferential direction U and/or the pitch of the internal thread can be varied over a wide range by a corresponding arrangement and/or a corresponding number of engagement elements, so that the internal thread can also be designed with multiple threads, for example.

FIGS. 9 to 11 show a molding tool 20 for producing the closure cap 2 shown in FIGS. 1 to 5. As can be seen from FIG. 9, the molding tool 20 comprises a first molding tool half 21 and a second molding tool half 22, which form a shaping cavity 23, preferably without an undercut, within which the closure cap 2 is produced by filling the cavity 23 with a plastic material by injection molding. In FIG. 9, the cavity 23 is already filled with plastic material. As can be seen from FIG. 10, the two mold halves 21, 22 are mutually displaceable in a linear direction of movement 24, wherein the direction of movement 24 runs parallel to the closure cap axis 10, and wherein the first mold half 21 has finger-shaped webs 21*a* which run in the direction of movement 24 and are spaced apart from the edge of the first mold half 21 by a gap 21*b*. As explained in detail in FIG. 11, these finger-shaped webs 21*a* are used in particular to produce the engagement elements 6, 6*b* . . . 6*m*. FIG. 11 shows the molding tool 20 in a fully extended state, in which the manufactured closure cap 2 can be removed. The first molding tool half 21 comprises an inner side surface 21*c* for producing the outer surface of the cap shell 3, and comprises a plurality of finger-shaped webs 21*a*, which have a boundary surface 21*d* at their tip. The second mold half 22 comprises an outer surface 22*a* for producing the inner surface of the cap shell 3, and comprises a plurality of grooves 22*c* which end in a boundary surface 22*b*. A groove 22*c* is assigned to each finger-shaped web 21*a*, whereby, as shown in FIG. 9, all finger-shaped webs 21*a* engage in the corresponding assigned grooves 22*c* when the molding tool 20 is closed, and internal cavities are formed by the boundary surfaces 21*d* and 22*b* and the side walls of the grooves 22*c*, which serve to produce the engagement elements 6. Each finger-shaped web 21*a* also creates a breakthrough 4, 4*b* . . . 4*m* in the cover disk 5 of the closure cap 2.

The method for producing a closure cap 2 having a closure cap axis 10, a cover disk 5 and a cylindrical cap shell 3 with at least one engagement element 6 projecting towards the closure cap axis 10 is carried out in such a way that a first mold half 21 and a second mold half 22 form a shaping cavity 23 in the closed state, wherein the outer contour of the closure cap 2 is determined by the first mold half 21, wherein the inner contour of the closure cap 2 is essentially determined by the second mold half 22, wherein the first mold half 21 has a finger-like web 21*a* which extends in the direction of the closure cap axis 10 and projects into the cavity 23, wherein a cavity part delimiting the engagement element 6 is defined by a mold part 22*b* of the second mold half 22 and by a tip 21*d* of the web 21*a* of the first mold half 21, so that when the cavity 23 is filled with plastic, the closure cap 2 comprising the cover disk and the cap shell 3 with engagement element 6 is produced. The web 21*a* also creates a breakthrough 4 in the cover disk 5. The two mold halves 21, 22 are displaced linearly relative to each other during opening, and the produced closure cap 2 is preferably released and ejected without forced demolding. The second mold half 22 comprises an end face 22*e*, in which a groove 22*d* for producing a sealing lip 11 is advantageously recessed. The groove 22*d* is preferably shaped in such a way that the sealing lip 11 produced is free of undercuts, so that the sealing lip 22 is removed from the second mold half 22 during a linear movement of the two mold halves 21, 22 in the direction of movement 24 without forced demolding. However, it may also prove advantageous to design the groove 22*d* in such a way that a sealing lip 11 with an undercut is produced. However, a sealing lip 11 designed in this way would be subject to forced deformation when removed from the second mold half 22.

FIGS. 12 to 19 show a further embodiment of a cap 2. The cap shell 3 is connected to a warranty tape 8 at the end section opposite the cover disk 5, the free edge 7. The warranty tape 8 is connected to the free edge 7 via a material weakening 9 running around in the circumferential direction U, preferably via a plurality of separating webs 9*a* spaced apart in the circumferential direction.

The warranty tape 8 comprises at least a single, and preferably a plurality of locking parts 8*b* projecting towards the closure cap axis 10. The at least one locking part 8*b* is arranged in the direction of the closure cap axis 10 below the breakthrough 4, and in particular aligned with respect to the breakthrough 4. Preferably, the warranty tape 8 comprises a plurality of locking parts 8*b*, 8*d*, 8*f*, 8*h* spaced apart from one another in the circumferential direction U, wherein one locking part 8*b*, 8*d*, 8*f*, 8*h* is assigned to each of certain breakthroughs 4, 4*b*, 4*c* in the direction of the closure cap axis 10. The break-through length 4*z* of the respective break-through 4, 4*b*, 4*c* is greater than or equal to a locking part length 8*z* of the associated locking part 8*a*, 8*b*, 8*c*. Preferably, both an engagement element 6 and a locking part 8*a* are assigned to the same breakthrough 4, 4*b*, 4*c* in succession in the circumferential direction U, as can be seen, for example, in FIGS. 13 and 14.

The closure cap 2 shown in FIGS. 1 to 8 could also be provided with a circumferential warranty tape 8. In an advantageous embodiment, the warranty tape 8 is connected to the cap shell 3 via an additional first connecting part 12*a* and an additional second connecting part 12*b*, wherein the first and second connecting parts 12*a*, 12*b* are advantageously connected to each other via a stronger or stiffer connecting part 14, and/or wherein the second connecting part 12*b* is connected to the warranty tape 8 via a stronger or stiffer connecting part 15. In addition to the direct connection to the cap shell 3, as shown in FIG. 16, for example, the first connecting section 12*a* is preferably also connected to the cap shell 3 via a first tear line 13*a* extending in the circumferential direction U. The first connecting section 12*a* and the second connecting section 12*b* are, in addition to the connecting part 14, preferably also connected to one another via a second tear line 13*b*. In addition to the connecting part 15, the second connecting section 12*b* is also connected to the warranty tape 8 via the material weakening 9, in particular separating webs 9*a*. However, the first and/or second tear line 13*a*, 13*b* could also be dispensed with.

A closure cap 2 comprising the first and/or the second connecting section 12*a*, 12*b* has the advantage that it is held on a container neck via the warranty tape 8 even after opening. Preferably, the closure cap or the connecting sections 12*a*, 12*b* are designed in such a way that the cap shell 3 is inseparably connected to the warranty tape 8, so that a closure cap preferably remains captively connected to a container neck even after it has been opened.

The closure cap 2 shown in FIGS. 12 to 19 is preferably produced with a molding tool which, in addition to the first and second molding tool halves 21, 22 shown in FIGS. 9 to 11, also comprises two further molding tool halves which are moved perpendicular to the direction of movement 24, and which in particular form the area of the warranty tape 8, and the connecting parts 14, 15 and the connecting parts 12*a*, 12*b*, or form the cavity for shaping the said parts. Such a molding tool is designed in particular in such a way that the end cap 2 can be produced and ejected from the molding tool without forced demolding.

FIG. 21 shows a side view, partly in section, of a container neck 31 of a container body 30. The container neck 31 comprises a pouring opening 32, an external thread 33, a projection 34, also referred to as a pilfer-proof ring, and a container neck ring 35. The container neck 31 has an end face 37 and a container outlet inner face 38. In addition, an end section 36 of the container body 30 is also shown. The sealing cap 2 according to the invention can, for example, be screwed onto such a container body 30. If the closure cap 2 comprises a warranty ring 8, its locking parts 8*a*, 8*b*, 8*c*, 8*d* preferably come to lie in the direction of the closure cap axis 10 below the projection 34. Advantageously, the locking parts 8*a*, 8*b*. 8*c*, 8*d* over the projection 34 as shown in FIGS. 22 and 23 in such a way that the warranty ring 8 is guided over the projection 34 in the position shown in FIG. 23, so that the warranty ring 8 then assumes the position shown in FIG. 22. The transfer of the warranty ring 8 is preferably carried out in FIG. 23 in such a way that no plastic deformation occurs on the warranty ring 8 and therefore no excessive tensile forces occur.

In an advantageous embodiment, the container interior is sealed by the sealing cap 2 in such a way that the end face 37 of the container neck 31 rests against the sealing cap 2. Particularly advantageously, as shown in FIG. 20, the sealing cap 2 also has a sealing lip 11 which rests against the inside of the container neck 38. Particularly advantageously, the container neck 31 comprises an inner container neck side 38 with an end section 39 which widens towards the pouring opening 32 and which advantageously widens conically by a constant angle $\alpha$, the angle $\alpha$ preferably being in a range between 0.5° and 5°. Particularly advantageously, the sealing lip 11 tapers towards its tip, especially advantageously at least in sections conically, at an angle $\beta$ that is preferably constant at least in sections. The sealing lip 11 can also be in the form of a sealing cylinder, a hollow cylinder or a sealing cone, for example. For a reliable seal, the container 30 preferably has a container neck 31 whose inner cross-section widens towards the pouring opening 32, and/or the sealing lip 11 preferably has an outer cross-section that tapers exclusively in the opposite direction of the closure cap axis 10 to the cover disk 5, as shown in FIG. 20. The embodiment shown in FIG. 20 is particularly suitable for sealing if the container neck 31 or the container body 30 and the closure cap 2 are made of the same material, in particular a material with a low coefficient of elasticity such as PET or essentially PET.

FIG. 24 shows a container body 30 whose container neck 31 is designed as part of a bayonet lock. The container neck 31 has a complementary engagement element 40 on its outer side with a sectional part 40*a* that runs perpendicular to the longitudinal axis of the container neck 31. FIG. 25 shows a closure cap 2 with a total of four engagement elements 6, 6*b*, 6*c*, 6*d* projecting towards the closure cap axis 10, these engagement elements being designed as bayonet locking parts, so that this closure cap 2 is suitable for closing the container body 30 shown in FIG. 24.

The container body 30, which is closed with the closure cap according to the invention, can be designed in a variety of ways, the container comprising a container neck 31 with an external thread 33 or with a bayonet locking part. The container can, for example, be designed as a bottle or as a cardboard container comprising a container neck.

Particularly preferably, at least the container neck and the closure cap are made of the same material, in particular generally of polyethylene terephthalate (PET). The entire container body, including the container neck, is particularly preferably made of the same material as the closure cap. This embodiment has the advantage that a container comprising the container body and the closure cap can be recycled particularly easily, especially if the warranty tape or fragments of the warranty tape are still on the container neck after the container has been opened, and in particular are connected to it.

In an advantageous embodiment, the breakthroughs 4, 4*b*, . . . 4*m* of the closure cap 2 could be closed after the closure cap 2 has been manufactured, for example by at least partially filling them with a material such as a plastic. In a further advantageous embodiment, the closure cap comprises an attachment, for example designed as a second cover disk, wherein this attachment has coupling parts extending in the direction of the closure cap axis 10, which are arranged and designed in such a way that they can be inserted into at least one and preferably into all breakthroughs 4, 4*b*, . . . 4*m* of the closure cap 2, and preferably can be firmly connected or are connected to the closure cap 2, preferably in such a way that the attachment lies against the first cover disk 5, and preferably lies flat, wherein the diameter of the attachment is preferably selected in such a way that the attachment covers all breakthroughs 4, 4*b*, . . . 4*m*. Advantageously, the attachment has the same diameter as the cover disk 5 of the closure cap 2. The attachment can be designed in a variety of ways and could, for example, also be designed as a container or a drinking vessel that is firmly or detachably connected to the closure cap 2.

The closure cap according to the invention is preferably designed in such a way that the cover disk has a breakthrough in the area of its periphery, and that the engagement element is arranged below the breakthrough in the direction of the closure cap axis and in alignment with the breakthrough in the direction of the closure cap axis.

In a further, advantageous embodiment, the closure cap according to the invention is designed such that the cover disk has a breakthrough in the region of its periphery, and that the engagement element is arranged below the breakthrough with respect to the breakthrough in the direction of the closure cap axis, wherein the engagement element is arranged in alignment with respect to the breakthrough, wherein this aligned direction does not run parallel to the closure cap axis, but has a different direction and, for example, runs inclined with respect to the closure cap axis.

The closure cap can also have a plurality of engagement elements and associated breakthroughs, wherein each engagement element is arranged in alignment with respect to the associated breakthrough, wherein the aligned directions do not run in the direction of the closure cap axis but are parallel and/or inclined to one another.

LIST OF REFERENCE SYMBOLS

1 Container closing device
2 Closure cap
3 Cap shell
3*a* Groove
4, 4*a*, 4*b*, 4*c*, 4*d*, 4*e*, 4*f*, 4*g*, 4*h*, 4*i*, 4*k*, 4*l*, 4*m* Breakthrough
4*y* Breakthrough width
4*z* Breakthrough length
5 Cover disk
6, 6*a*, 6*b*, 6*c*, 6*d*, 6*e*, 6*f*, 6*g*, 6*h*, 6*i*, 6*k*, 6*l*, 6*m* Engagement element
6*y* Engagement element width
6*z* Engagement element length
7 Free edge
8 warranty tape
8*a*, 8*b*, 8*c* Locking part
9 Material weakening
9*a* Separating web
10 Closure cap axis
11 Sealing lip
12 Connecting strip
12*a* First connecting section
12*b* Second connecting section
13*a* First tear line
13*b* second tear line
14 Connecting part
15 Connecting part
20 Molding tool
21 First mold half
21*a* web
21*b* Gap
21*c* Inner side surface
21*d* Boundary surface
22 Second mold half
22*a* Outer side surface
22*b* Boundary surface
22*c* Groove
22*d* Recess
22*e* End face
23 Shaping cavity
24 Direction of movement
30 Container body
31 Container neck
32 Pouring opening
33 External thread
34 Projection
35 Container neck ring
36 End section
37 End face
38 Container outlet inner face
39 Widening end section
40 Complementary engagement element
40*a* Section part
S Pitch
U Circumferential direction
U1 Opening direction of rotation

The invention claimed is:

1. A closure cap with a closure cap axis, a cylindrical cap shell, a cover disk, and an engagement element formed on an inside of the cap shell and projecting towards the closure cap axis, the engagement element being designed as an internally threaded part or as a bayonet locking part, wherein the cover disk has a breakthrough in a region of its periphery, and wherein the engagement element is arranged below the breakthrough with respect to the breakthrough in a direction of the closure cap axis; and wherein the closure cap has a plurality of breakthroughs and engagement elements which are arranged mutually spaced apart in a circumferential direction, wherein each engagement element is assigned a corresponding breakthrough in the direction of the closure cap axis, and wherein an engagement element length of the engagement element is less than or equal to a breakthrough length of the respectively assigned breakthrough.

2. The closure cap according to claim 1, wherein the engagement element is arranged in alignment with the breakthrough in the direction of the closure cap axis.

3. The closure cap according to claim 1, wherein the breakthrough has the breakthrough length with respect to a circumferential direction of the closure cap axis, and wherein the engagement element has the engagement element length in the circumferential direction, and wherein the breakthrough length is greater than or equal to the engagement element length.

4. The closure ap according to claim 1, wherein the engagement element lengths of the engagement elements are the same length as the breakthrough length of the respectively assigned breakthrough.

5. The closure ap according to claim 4, wherein all of the breakthroughs and all of the engagement elements have the same length in the circumferential direction.

6. The closure cap according to claim 1, wherein the closure cap has at least eight breakthroughs and engagement elements, each engagement element being assigned a respective breakthrough.

7. The closure cap according to claim 3, each engagement element forms an internally threaded part, internally threaded parts being arranged mutually offset in the direction of the closure cap axis in such a way that the entirety of the engagement elements form an internal thread with a pitch in the circumferential direction.

8. The closure cap according to claim 7, wherein the cover disk comprises a circumferential sealing lip which runs in the circumferential direction between the breakthrough and the closure cap axis.

9. The closure cap according to claim 8, wherein the circumferential sealing lip is formed on the cover disk.

10. The closure cap according to claim 9, wherein the sealing lip is designed to be free of undercuts.

11. The closure cap according to claim 9, wherein the closure cap consists of polyethylene terephthalate (PET) or essentially of polyethylene terephthalate (PET).

12. The closure cap according to claim 8, wherein the sealing lip is hollow-cylindrical in shape.

13. The closure cap according to claim 8, wherein an outer cross-section of the sealing lip tapers in an opposite direction of the closure cap axis to the cover disk.

14. The closure cap according to claim 1, wherein the cap shell has a free edge at an end section opposite the cover disk, wherein a warranty tape is connected to a free edge via a material weakening running around in the circumferential direction, wherein the warranty tape comprises a locking part projecting towards the closure cap axis, and wherein the locking part is arranged in the direction of the closure cap axis below the breakthrough.

15. The closure cap according to claim 14, wherein the warranty tape is connected to the free edge via separating webs.

16. The closure cap according to claim 14, wherein the locking part is arranged in alignment with respect to the breakthrough.

17. The closure cap according to claim 14, wherein the warranty tape comprises a plurality of locking parts arranged mutually spaced apart in the circumferential direction, wherein certain openings in the direction of the closure cap axis are each assigned a locking part, and wherein the breakthrough length of the respective breakthrough is greater than or equal to a locking part length of the assigned locking part.

18. The closure cap according to claim 14, wherein both an engaging element and a locking part are assigned to the same breakthrough in succession in the circumferential direction.

19. A container comprising a pouring opening and comprising a closure cap according to claim 1, wherein the pouring opening is closed with the closure cap.

20. The container according to claim 19, wherein the container and the closure cap are made of the same material.

21. The container according to claim 20, wherein the container and the closure cap are made of polyethylene terephthalate (PET) or essentially of polyethylene terephthalate (PET).

22. The container according to claim 20, wherein at least one of the container has a container neck, an inner cross-section of which widens towards a pouring opening, and a sealing lip has an exclusively tapering outer cross-section in the direction of the closure cap axis opposite to the cover disk.

23. The container according to claim 22, wherein the inner cross-section of the container neck widens conically towards the pouring opening.

24. The container according to claim 23, wherein the inner cross-section of the container neck widens conically by a constant opening angle.

25. The container according to claim 23, wherein the opening angle lies in a range between 0.5° and 5°.

26. A method for producing a closure cap, having a closure cap axis, a cover disk and a cylindrical cap shell with an engagement element projecting towards the closure cap axis, in that a first mold half and a second mold half form a shaping cavity in the closed state, in that the outer contour of the closure cap is determined by the first mold tool half, in that the inner contour of the closure cap is essentially determined by the second mold tool half, the first mold tool half having a finger-like web extending in the direction of the closure cap axis, which projects into the cavity, a cavity part delimiting the engagement element being defined by a mold part of the second mold half and by a tip of the web of the first mold half, so that when the cavity is filled with plastic, the closure cap comprising the cover disk and the cap shell with engagement element is produced, wherein the web also produces a breakthrough in the cover disk, wherein the two halves of the mold are displaced linearly relative to each other during opening, and the produced closure cap is released and ejected without forced demolding, and wherein the closure cap has a plurality of breakthroughs and engagement elements which are arranged mutually spaced apart in a circumferential direction, wherein each of the engagement elements is assigned a corresponding breakthrough in the direction of the closure cap axis, and wherein the engagement element length of the engagement element is less than or equal to the breakthrough length of the respectively assigned breakthrough.

* * * * *